US005663040A

United States Patent [19]

Bertoldi et al.

[11] Patent Number: 5,663,040

[45] Date of Patent: Sep. 2, 1997

[54] SILVER HALIDE PHOTOGRAPHIC ELEMENTS CONTAINING 2-EQUIVALENT 5-PYRAZOLONE MAGENTA COUPLERS

[75] Inventors: Massimo Bertoldi, Fossano; Enzo Coraluppi, Carcare; Anna Marie Canuti, Genoa; Ferdinando Orengo, Altare, all of Italy

[73] Assignee: Imation Corp. Oakdale, Minn.

[21] Appl. No.: 605,573

[22] Filed: Feb. 22, 1996

[30] Foreign Application Priority Data

Mar. 28, 1995 [EP] European Pat. Off. ..... 95104545

[51] Int. Cl.[6] ..... G03C 7/384

[52] U.S. Cl. ..... 430/555

[58] Field of Search ..... 430/555

[56] References Cited

U.S. PATENT DOCUMENTS

| | | | |
|---|---|---|---|
| 4,413,054 | 11/1983 | Mitsui et al. | 430/555 |
| 4,556,630 | 12/1985 | Furatachi et al. | 430/372 |
| 4,584,266 | 4/1986 | Hirose et al. | 430/555 |
| 4,804,617 | 2/1989 | Nishikawa et al. | 430/555 |
| 4,900,657 | 2/1990 | Crawley et al. | 430/555 |
| 4,904,579 | 2/1990 | Mihayashi et al. | 430/555 |
| 5,256,528 | 10/1993 | Merkel et al. | 430/555 |
| 5,389,504 | 2/1995 | Ling et al. | 430/555 |
| 5,447,830 | 9/1995 | Pawlak et al. | 430/555 |
| 5,476,756 | 12/1995 | Chari et al. | 430/555 |

FOREIGN PATENT DOCUMENTS

| | | | |
|---|---|---|---|
| 0 529 727 A1 | 8/1991 | European Pat. Off. | G03C 7/388 |
| 0 510 576 A1 | 10/1992 | European Pat. Off. | G03C 7/30 |
| 3 241 886 A1 | 6/1983 | Germany | C07D 231/14 |
| 2-34842 | 2/1990 | Japan | G03C 7/384 |
| 2040649 | 2/1990 | Japan | 430/555 |
| 1 494 777 | 12/1977 | United Kingdom | G03C 7/38 |
| WO92/18902 | 10/1992 | WIPO | G03C 7/384 |

*Primary Examiner*—Lee C. Wright
*Attorney, Agent, or Firm*—Mark A. Litman

[57] ABSTRACT

Silver halide photographic element comprising a support and at least one silver halide emulsion layer having therein a 2-equivalent 5-pyrazolone magenta coupler represented by the formula:

wherein a represents an integer from 0 to 3, b represents an integer from 0 to 2, $R_1$ and $R_2$ are each individually hydrogen, alkyl, alkoxy, halogen, aryl, aryloxy, acylamino, sulfonamido, sulfamoyl, carbamoyl, arylsulfonyl, aryloxycarbonyl, alkoxycarbonyl, alkoxysulfonyl, aryloxysulfonyl, alkylureido, arylureido, nitro, cyano, hydroxyl or carboxy group, $R_3$ is halogen atom, alkyl or aryl group, X is a direct link or a linking group, Ball is a ballasting group which renders a group to which is attached non-diffusible in photographic coatings, and the sum of the sigma values of $R_1$, $R_3$ and X-Ball is less than 1.3.

10 Claims, No Drawings

SILVER HALIDE PHOTOGRAPHIC ELEMENTS CONTAINING 2-EQUIVALENT 5-PYRAZOLONE MAGENTA COUPLERS

FIELD OF THE INVENTION

The present invention relates to silver halide photographic elements containing 2-equivalent 5-pyrazolone magenta couplers. More particularly, the present invention relates to silver halide photographic elements containing 2-equivalent 1-phenyl-3-anilino-4-phenylthio-5-pyrazolone magenta couplers.

BACKGROUND OF THE INVENTION

It is known that color images may be obtained from imagewise exposed silver halide photographic elements by development with a primary aromatic amine color developing agent in the presence of a color coupler. The oxidized color developing agent formed in the areas of silver halide development couples with the coupler to form a dye. The coupler is normally incorporated in the sensitive photographic element.

It is also known that 5-pyrazolones in which the 4-position of the pyrazolone ring is free, that is having only hydrogen substituents (4-equivalent magenta couplers), can be used as magenta couplers in color photographic elements to provide magenta dye images having useful properties. Examples of such couplers are the 4-equivalents 3-anilino-5-pyrazolone couplers described in, for example, U.S. Pat Nos. 3,519,429, 3,907,571, 3,928,044, 3,935,015 and 4,199,361. However, 4-equivalent 5-pyrazolone couplers have a number of disadvantages, as they require four equivalents of silver to produce each molecule of dye, are sensitive to certain chemical vapors, for example formaldehyde, and have poor dye light and dye dark stability. These drawbacks can be overcome by using so-called 2-equivalent 5-pyrazolone magenta couplers in which a substituent is introduced into the coupling position (4-position) of the coupler and eliminated as a leaving group (coupling-off group or splitting-off groups) during the color development process, thus requiring only two equivalent of silver in order to produce each molecule of dye.

Among coupling-off groups known in this connection are the arylthio groups described, for example, in U.S. Pat. Nos. 3,227,554, 3,701,783, 3,935,015, 4,351,897, 4,413,054, 4,556,630, 4,584,266, 4,740,438, 4,853,319, 4,876,182, 4,900,657, 4,929,540, 4,942,116, 5,250,407, 5,262,292, and 5,256,528; WO 88/04795, 92/18902, and 93/02393; EP 341,204, and GB 1,494,777.

A problem with 2-equivalent magenta couplers is that the magenta image dye formed in the processed photographic elements has rather low fastness to light.

Another disadvantage associated with the 2-equivalent 5-pyrazolone magenta couplers is that they have low pKa values, so that they may be significantly ionized at low pH. Thus, 2-equivalent 5-pyrazolone magenta couplers can exihibit an undesirable non-imagewise dye formation (continued coupling) owing to coupling with developer that is carried over into the bleach solution and oxidized therein. This phenomenon produces undesirable increase in background density (Dmin). Continued coupling also produces unacceptable dye density variability in processed color photographic elements due to variations of bleach pH as the bleach solution becomes seasoned by continuous use.

Thus, there is the need to provide silver halide color photographic elements containing 2-equivalent 5-pyrazolone magenta couplers which exhibit a reduction in the continued coupling phenomenon and form magenta dye images having improved fastness to light.

GB 1,494,777 describes 2-equivalent 1-aryl-3-anilino-4-arylthio-5-pyrazolone magenta couplers wherein the arylthio group contains a ballasting group linked to the aryl group either directly or through a divalent linking group such as an imino, ether, carbonamido, sulfonamido, ureido, imido, carbamoyl or sulfamoyl bond. No examples of couplers having a ballasting group on both the anilino and arylthio groups are disclosed.

U.S. Pat. No. 4,413,054 describes 2-equivalent 1-aryl-3-anilino-4-phenylthio-5-pyrazolone magenta couplers wherein the phenylthio group may be substituted with halogen atoms, alkyl, alkoxy, alkoxycarbonyl, acylamino, sulfonamido, carbamoyl, sulfamolyl, alkylthio, hydroxy, or arly groups. No examples of phenylthio groups having carbamoyl groups in the 2-position with respect to the carbon atom attached to the sulfur atom are reported.

U.S. Pat. Nos. 4,556,630 and 4,584,266 describe 2-equivalent 1-aryl-3-anilino-4-phenylthio-5-pyrazolone magenta couplers wherein the 4-phenylthio group may be substituted with halogen atom, or hydroxy, amino, alkyl, alkoxy, aryl, acylamino, ureido, alkoxycarbonylamino, imido, sulfonamido, sulfamoyl, nitro, alkoxycarbonyl, carbamoyl, acyl, cyano or alkylthio groups. No examples of couplres having a carbamoyl group on the phenylthio group are disclosed.

U.S. Pat. No. 4,900,657 describes 2-equivalent 1-phenyl-3-anilino-4-arylthio-5-pyrazolone magenta couplers wherein the 1-phenyl group has at least 4 Cl atoms and the 4-arylthio group has in ortho position a sulfonamido, carbonamido, ureido, carbamoyl, amino, alkyl or alkoxy group. No examples of couplers having a carbamoyl group on the arylthio group are disclosed.

U.S. Pat. No. 5,256,528 describes 2-equivalent 1-phenyl-3-anilino-4-phenylthio 5-pyrazolone magenta couplers wherein the 4-phenylthio group has in ortho position a halogen atom, or an alkyl, alkoxy, aryloxy, carbamate, sulfonamido, carbonamido, ureido, carbamoyl, sulfamoyl, acyloxy, alkoxycarbonyl, aryloxycarbonyl, amino, or carboxyl group. No examples of couplers having a carbamoyl group on the phenylthio group are disclosed.

WO 92/18902 describes 2-equivalent 1-phenyl-3-anilino-4-phenylthio 5-pyrazolone magenta couplers wherein the ortho position of the phenylthio group is substituted with carbamoyl, alkoxysulfonyl, aryloxysulfonyl, alkysulfovyl, arylsulfonyl, alkoxycarbonyl, aryloxycarbonyl, sulfamoyl, acyloxy, acylamino, nitro, cyano, or amine group, and the sum of the sigma values for substituents on the 1-phenyl and 3-anilino groups is at least 1.3.

EP 510,576 and 529,727 describe the continued coupling of two-equivalent 5-pyrazolone magenta coupler as caused by the low pKa values of said couplers and provide a solution to this adverse phenomenon by combining the two-equivalent 5-pyrazolone magenta coupler with a sulfoxide compound and; respectively, a carbonamide compound and at least one compound selected from the group consisting of anilines and amines.

SUMMARY OF THE INVENTION

The present invention relates to a silver halide photographic element comprising a support and at least one silver halide emulsion layer having a 2-equivalent 1-phenyl-3-anilino-4-phenylthio-5-pyrazolone magenta coupler, wherein both the 3-anilino and 4-phenylthio groups comprise a ballasting group, the 4-phenylthio group comprises a carbamoyl group being in 2-position with respect to the carbon atom attached to the sulfur atom and bearing said ballasting group, and the sum of sigma values of substituents on the 1-phenyl and the 3-aniline groups is less than 1.3.

In particular, said 5-pyrazolone magenta coupler may be represented by the formula:

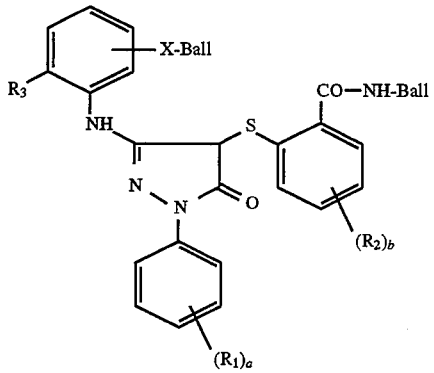

wherein a represents an integer from 0 to 3, b represents an integer from 0 to 2, $R_1$ and $R_2$ are each individually hydrogen, alkyl, alkoxy, halogen, aryl, aryloxy, acylamino, sulfonamido, sulfamoyl, carbamoyl, arylsulfonyl, aryloxycarbonyl, alkoxycarbonyl, alkoxysulfonyl, aryloxysulfonyl, alkylureido, arylureido, nitro, cyano, hydroxyl or carboxy group, $R_3$ is halogen atom, alkyl group or aryl group, X is a direct link or a linking group, Ball is a ballasting group of such size and configuration as to render a group to which is attached non-diffusible in photographic coatings, and the sum of the sigma values of $R_1$, $R_3$ and X-Ball is less than 1.3.

The color photographic elements containing the 2-equivalent 1-phenyl-3-anilino-4-phenylthio-5-pyrazolone magenta couplers described above have various advantages, for example, in that the color images formed are fast to light, the photographic properties are not influenced by continued coupling, and color images having improved granularity are obtained.

DETAILED DESCRIPTION OF THE INVENTION

In the above formula, examples of $R_1$ and $R_2$ include hydrogen; alkyl group, including straight or branched chain alkyl group, such as alkyl group containing 1 to 8 carbon atoms, for example methyl, trifluoromethyl, ethyl, butyl, and octyl; alkoxy group, such as an alkoxy group having 1 to 8 carbon atoms, for example methoxy, ethoxy, propoxy, 2-methoxyethoxy, and 2-ethylhexyloxy; halogen, such as chlorine, bromine, and fluorine; aryl group, such as phenyl, naphthyl, and 4-tolyl; aryloxy group, such as phenoxy, p-methoxyphenoxy, p-methylphenoxy, naphthyloxy, and tolyloxy; acylamino group, such as acetamido, benzamido, butyramido, and t-butylcarbonamido; sulfonamido group, such as methylsulfonamido, benzenesulfonamido, and p-toluylsulfonamido; sulfamoyl group, such as N-methylsulfamoyl, N,N-diethylsulfamoyl, and N,N-dimethylsulfamoyl; carbamoyl group, such as N-methylcarbamoyl, and N,N-dimethylcarbamoyl; arylsulfonyl, such as tolylsulfonyl; aryloxycarbonyl group, such as phenoxycarbonyl; alkoxycarbonyl group, such as alkoxycarbonyl group containing 2 to 10 carbon atoms, for example methoxycarbonyl, ethoxycarbonyl, and benzyloxycarbonyl; alkoxysulfonyl group, such as alkoxysulfonyl group containing 2 to 10 carbon atoms, for example methoxysulfonyl, octyloxysulfonyl, and 2-ethylhexylsulfonyl; aryloxysulfonyl group, such as phenoxysulfonyl; alkylureido group, such as N-methylureido, N,N-dimethylureido, and N,N-dibutylureido; arylureido group, such as phenylureido; nitro, cyano, hydroxyl and carboxy group.

Examples of $R_3$ include halogen, such as chlorine, bromine, and fluorine; alkyl group, including straight or branched chain alkyl group, such as alkyl group containing 1 to 8 carbon atoms, for example methyl, trifluoromethyl, ethyl, butyl, and octyl; aryl group, such as phenyl, naphthyl, and 4-tolyl.

"Ball" is a ballasting group, i.e., an organic group of such size and configuration as to render a group to which is attached non-diffusible from the layer in which is coated in a photographic element. Said ballasting group includes an organic hydrophobic residue having 8 to 32 carbon atoms bonded to the coupler either directly or through a divalent linking group, such as an alkylene, imino, ether, thioether, carbonamido, sulfonamido, ureido, ester, imido, carbamoyl, and sulfamoyl group. Specific examples of suitable ballasting groups include alkyl groups (linear, branched, or cyclic), alkenyl groups, alkoxy groups, alkylaryl groups, alkylaryloxy groups, acylamidoalkyl groups, alkoxyalkyl groups, alkoxyaryl groups, alkyl groups substituted with an aryl group or a heterocyclic group, aryl groups substituted with an aryloxyalkoxycarbonyl group, and residues containing both an alkenyl or alkenyl long-chain aliphatic group and a carboxy or sulfo water-soluble group, as described, for example, in U.S. Pat. Nos. 3,337;344, 3,418,129, 3,892,572, 4,138,258, and 4,451,559, and in GB 1,494,777.

When the term "group" or "residue" is used in this invention to describe a chemical compound or substituent, the described chemical material includes the basic group or residue and that group or residue with conventional substitution. Where the term "moiety" is used to describe a chemical compound or substituent, only the unsubstituted chemical material is intended to be included. For example, "alkyl group" includes not only such alkyl moiety as methyl, ethyl, butyl, octyl, stearyl, etc., but also moieties bearing substituent groups such as halogen, cyano, hydroxyl, nitro, amino, carboxylate, etc. On the other hand, "alkyl moiety" includes only methyl, ethyl, stearyl, cyclohexyl, etc.

In the present invention, the sum of sigma values of substituents on the 1-phenyl and 3-anilino groups, such as $R_1$, $R_3$ and -X-Ball is less than 1.3. The values of sigma constants can be easily found in the published literature (see, for example, "The Chemists' Companion", A. J. Gordon and R. A. Ford, John Wiley & Sons, New York, 1972, "Progress in Physical Organic Chemistry", V. 13, R. W. Taft, John Wiley & Sons, New York, "Substituents Constants for Correlation Analysis in Chemistry and Biology", C. Hansch and A. J. Leo, John Wiley & Sons, New York, 1979, and "Comprehensive Medicinal Chemistry", A. J. Leo, Pergamon Press, New York, V. 4, 1990), or can be calculated using the Medchem program (see "Comprehensive Medicinal Chemistry", A. J. Leo, Pergamon Press, New York, V. 4, 1990). Generally, sigma values increase with increasing electron withdrawing power of the substituent, with hydrogen =zero. For sigma values, only the atoms dose to the phenyl ring have an electron withdrawing effect and remote atoms have no effect. Examples of sigma values for chemical groups or atoms are as follows: alkyl group=–017, chlorine atom=0.23, alkoxycarbonyl group=0.45, acylamino group=0.21, sulfamoyl group=0.57, alkylsulfonyl group=0.78, and carbamoyl=0.36.

Among the couplers described above, a preferred embodiment is represented by the above formula wherein the groups $R_1$ are chlorine atom=is 3, and the chlorine atoms are attached to the carbon atoms in position 2, 4 and 6 with respect to the carbon atom attached to the nitrogen atom.

A particularly preferred embodiment is represented by the above formula wherein the group $R_3$ is a chlorine atom.

Specific examples of 2-equivalent 1-phenyl-3-anilino-4-phenylthio-5-pyrazolone magenta couplers for use in the present invention are illustrated below, but the present invention should not be construed as being limited thereto.

I-1

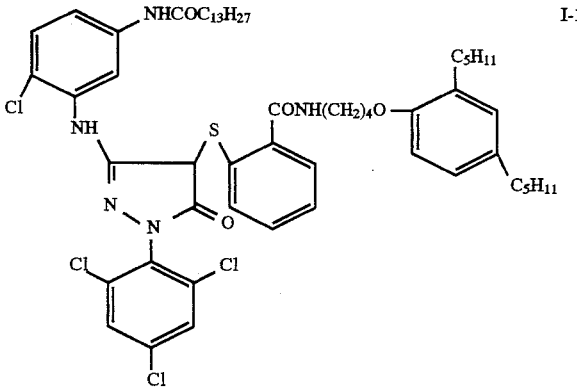

I-2

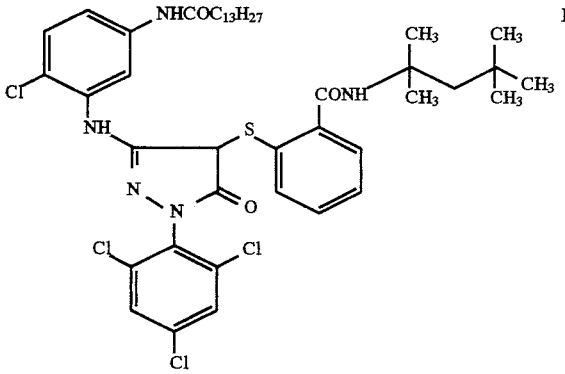

I-3

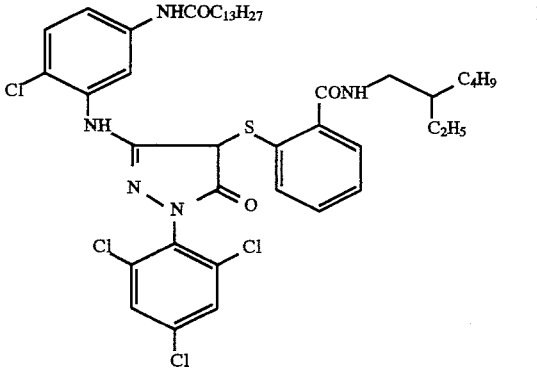

-continued

I-4

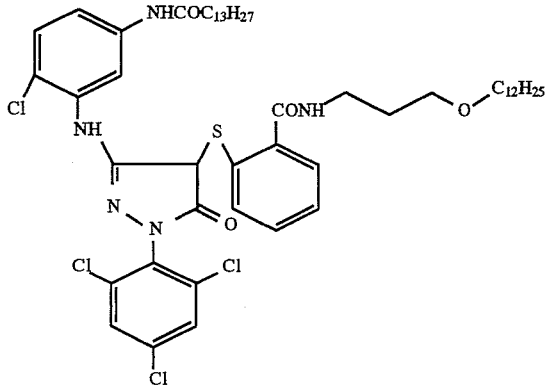

Other illustrative couplers include:

I-5

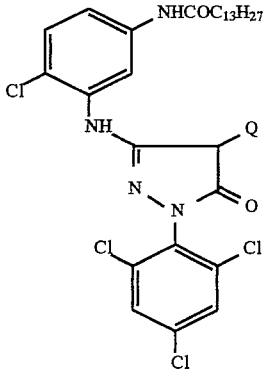

I-6

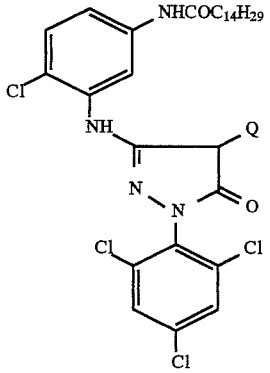

I-7

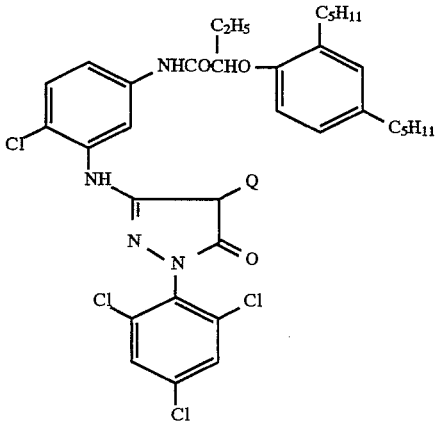

-continued

I-8

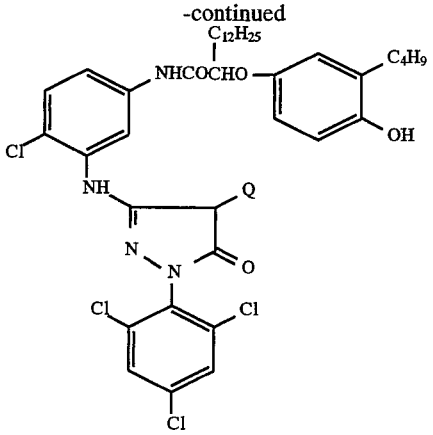

I-9

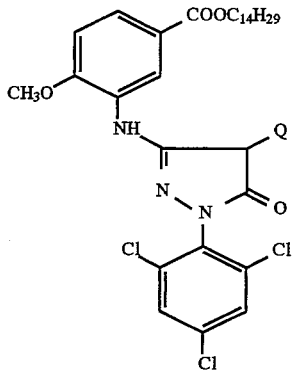

wherein Q represents a coupling-off group according to the invention.

Illustrative coupling-off groups Q are as follows:

Q-1

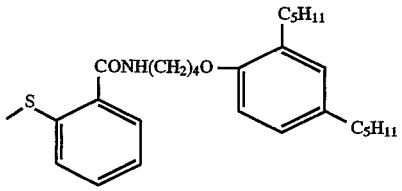

Q-2

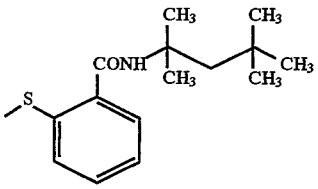

Q-3

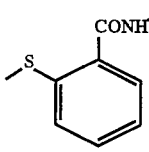

Q-4

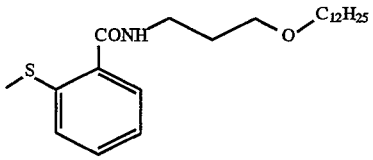

-continued

Q-5

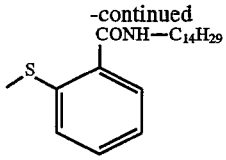

Q-6

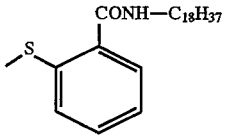

Q-7

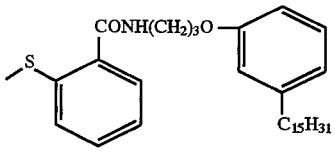

The amount of the 2-equivalent-1-phenyl-3-anilino-4-phenylthio-5-pyrazolone magenta couplers which can be used in the photographic element of the present invention can be varied depending upon the intended use of the photographic element, the structure of the coupler and the conditions of color processing. In general, the amount of the coupler can be varied from 0.1 to 2 millimoles per square meter of the photographic element.

The couplers according to the invention can be prepared by the following illustrative synthetic scheme, where COUP is a 4-equivalent magenta coupler:

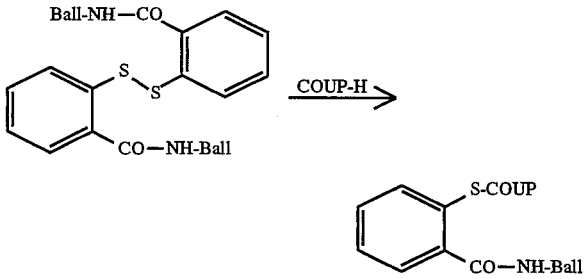

wherein COUP is the coupler moiety and Ball is as defined.

The following example illustrate the preparation of couplers of this invention.

Synthesis Example 120 g of 2.2'-dithiodibenzoic acid were added to 800 ml of thionyl chloride. Under stirring, the solution was refluxed for 6 hours and, after evaporation of the solvent, 100 ml of dry toluene were added. A pale yellow-brown solid was collected by filtration and dried overnight under vacuum to obtain 2,2'-dithiodibenzoyl chloride in 80% yield.

108 g of 2,2'-dithiodibenzoyl chloride were suspended in 100 ml acetone and added dropwise with 185 g of 2,4-di-tert.-amylphenoxybutylamine dissolved in 500 ml of acetone. The temperature of the solution was raised to 40° C. Then, 61 g of triethylamine were added dropwise. The suspension was poured in 2,000 ml of water, the precipitate was filtered, washed with ethanol and crystallized from ethanol. The yield was 75% of the intermediate compound having the formula:

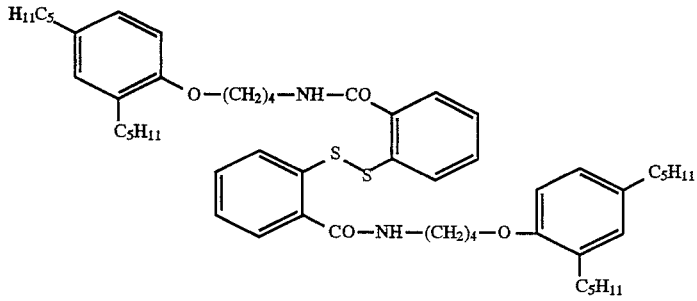

89 g of the intermediate compound above and 118 g of the 4-equivalent coupler of formula

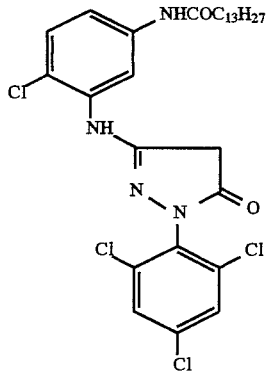

were dissolved in 700 ml of dry dimethylformamide. 18 g of bromine were added dropwise and the solution was stirred at 50° C. for 24 hours. The solution was poured into 4 l water at pH 1. The yellow solid was collected and purified by silica gel chromatography (ethylacetate/methylene chloride). The yield was 75% of 2-equivalent 5-pyrazolone magenta coupler I-1.

The color photographic elements of the present invention can be conventional photographic elements containing a silver halide as a light-sensitive substance.

The silver halides used in the multilayer color photographic elements of this invention may be a fine dispersion (emulsion) of silver chloride, silver bromide, silver chlorobromide, silver iodo-bromide and silver chloro-iodobromide grains in a hydrophilic binder. Preferred silver halides are silver iodo-bromide or silver iodo-bromochloride containing 1 to 20% mole silver iodide in silver iodo-bromide emulsions or silver iodo-bromo-chloride, the iodide can be uniformly distributed among the emulsion grains, or iodide level can varied among the grains. The silver halides can have a uniform grain size or a broad grain size distribution. The silver halide grains may be regular grains having a regular crystal structure such as cubic, octahedral, and tetradecahedral, or the spherical or irregular crystal structure, or those having crystal defects such as twin plane, or those having a tabular form, or the combination thereof.

The term "cubic grains" according to the present invention is intended to include substantially cubic grains, that is grains which are regular cubic grains bounded by crystallographic faces (100), or which may have rounded edges and/or vertices or small faces (111), or may even be nearly spherical when prepared in the presence of soluble iodides or strong ripening agents, such as ammonia. Particularly good results are obtained with silver halide grains having average grain sizes in the range from 0.2 to 3 μm, more preferably from 0.4 to 1.5 μm. Preparation of silver halide emulsions comprising cubic silver iodobromide grains is described, for example, in Research Disclosure, Vol. 184, Item 18431, Vol. 176, Item 17644 and Vol. 308, Item 308119.

Other silver halide emulsions for use in this invention are those which employ one or more light-sensitive tabular grain emulsions. The tabular silver halide grains contained in the emulsion of this invention have an average diameter:thickness ratio (often referred to in the art as aspect ratio) of at least 2:1, preferably 2:1 to 20:1, more preferably 3:1 to 14:1, and most preferably 3:1 to 8:1. Average diameters of the tabular silver halide grains suitable for use in this invention range from about 0.3 μm to about 5 μm, preferably 0.5 μm to 3 μm, more preferably 0.8 μm to 1.5 μm. The tabular silver halide grains suitable for use in this invention have a thickness of less than 0.4 μm, preferably less than 0.3 μm and more preferably less than 0.2 μm.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition, the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 2:1. Each of the above proportions, "15%", "25%" and "50%" means the proportion of the total projected area of the tabular grains having a diameter:thickness ratio of at least 2:1 and a thickness lower than 0.4 μm, as compared to the projected area of all of the silver halide grains in the layer.

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. References can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, 3,979,213, Research Disclosure, December 1989, Item 308119 "Photographic Silver Halide Emulsions, Preparations, Addenda, Processing and Systems", and Research Disclosure, September 1976, Item 14987.

One common technique is a batch process commonly referred to as the double-jet precipitation process by which a silver salt solution in water and a halide salt solution in water are concurrently added into a reaction vessel containing the dispersing medium.

In the double jet method, in which alkaline halide solution and silver nitrate solution are concurrently added in the gelatin solution, the shape and size of the formed silver halide grains can be controlled by the kind and concentration of the solvent existing in the gelatin solution and by the addition speed. Double-jet precipitation processes are described, for example, in GB 1,027,146, GB 1,302,405, U.S. Pat. No. 3,801,326, U.S. Pat. No. 4,046,376, U.S. Pat. Nos. 3,790,386, U.S. Pat. No. 3,897,935, U.S. Pat. No. 4,147,551, and U.S. Pat. No. 4,171,224.

The single jet method in which a silver nitrate solution is added in a halide and gelatin solution has been long used for manufacturing photographic emulsion. In this method, because the varying concentration of halides in the solution determines which silver halide grains are formed, the formed silver halide grains are a mixture of different kinds of shapes and sizes.

Precipitation of silver halide grains usually occurs in two distinct stages. In a first stage, nucleation, formation of fine silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic material from crystallizing out after coating and other photographic or mechanical disadvantages (stickiness, brittleness, etc.), the soluble salts formed during precipitation have to be removed.

In preparing the silver halide emulsions for use in the present invention, a wide variety of hydrophilic dispersing agents for the silver halides can be employed. As hydrophilic dispersing agent, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethylcellulose, etc. a synthetic resin, such as polyvinyl alcohol, polyvinylpyrrolidone, polyacrylamide, etc. Other hydrophilic materials useful known in the art are described, for example, in Research Disclosure, Vol. 308, Item 308119, Section IX.

The silver halide grain emulsion for use in the present invention can be chemically sensitized using sensitizing agents known in the art. Sulfur containing compounds, gold and noble metal compounds, and polyoxylakylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section III, 1989.

The silver halide emulsion for use in the present invention can be spectrally sensitized with dyes from a variety of classes, including the polymethyne dye class, which includes the cyanines, merocyanines, complex cyanines and merocyanines, oxonols, hemioxonols, styryls, merostyryls, and streptocyanine.

The cyanine spectral sensitizing dyes include, joined by a methine linkage, two basic heterocyclic nuclei, such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellurazole, oxatellurazole.

The merocyanine spectral sensitizing dyes include, joined by a methine linkage, a basic heterocyclic nucleus of the cyanine-dye type and an acidic nucleus, which can be derived from barbituric acid, 2-thiobarbituric acid, rhodanine, hydantoin, 2-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, chromane-2,4-dione, and the like.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depends on the region of the spectrum to which sensitivity is desired and on the shape of the spectral sensitivity desired.

Examples of sensitizing dyes can be found in Venkataraman, *The chemistry of Synthetic Dyes*, Academic Press, New York, 1971, Chapter V, James, *The Theory of the Photographic Process*, 4th Ed., Macmillan, 1977, Chapter 8, F. M. Hamer, *Cyanine Dyes and Related Compounds*, John Wiley and Sons, 1964, and in Research Disclosure 308119, Section III, 1989.

The silver halide emulsions for use in this invention can contain optical brighteners, antifogging agents and stabilizers, filtering and antihalo dyes, hardeners, coating aids, plasticizers and lubricants and other auxiliary substances, as for instance described in Research Disclosure 17643, Sections V, VI, VIII, X, XI and XII, 1978, and in Research Disclosure 308119, Sections V, VI, VIII, X, XI, and XII, 1989.

The silver halide emulsion for use in the present invention can be used for the manufacture of multilayer light-sensitive silver halide color photographic elements, such as color negative photographic elements, color reversal photographic elements, color positive photographic elements, false color address photographic elements (such as those disclosed in U.S. Pat. No. 4,619,892) and the like, the preferred ones being color negative photographic elements.

Silver halide multilayer color photographic elements usually comprise, coated on a support, a red sensitized silver halide emulsion layer associated with cyan dye-forming color couplers, a green sensitized silver halide emulsion layer associated with magenta dye-forming color couplers and a blue sensitized silver halide emulsion layer associated with yellow dye-forming color couplers. Each layer can be comprised of a single emulsion layer or of multiple emulsion sub-layers sensitive to a given region of visible spectrum. When multilayer materials contain multiple blue, green or red sub-layers, these can be in any case relatively faster and relatively slower sub-layers. These elements additionally comprise other non-light sensitive layers, such as intermediate layers, filter layers, antihalation layers and protective layers, thus forming a multilayer structure. These color photographic elements, after imagewise exposure to actinic radiation, are processed in a chromogenic developer to yield a visible color image. The layer units can be coated in any conventional order, but in a preferred layer arrangement the red-sensitive layers are coated nearest the support and are overcoated by the green-sensitive layers, a yellow filter layer and the blue-sensitive layers.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. patent 3,892,572.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an α-naphthol compound, is associated with red-sensitive silver halide emulsion layers, at least one non-diffusible magenta image-forming color coupler, generally a 5-pyrazolone or a pyrazolotriazole compound, is associated with green-sensitive silver halide emulsion layers and at least one non-diffusible yellow image forming color coupler, generally an acylacetanilide compound, is associated with blue-sensitive silver halide emulsion layers.

Said color couplers may be 4-equivalent and/or 2-equivalent couplers, the latter requiring a smaller amount of silver halide for color production. As it is well known, 2-equivalent couplers derive from 4-equivalent couplers since, in the coupling position, they contain a substituent which is released during coupling reaction. 2-equivalent couplers which may be used in silver halide color photographic elements include both those substantially colorless and those which are colored ("masking couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

The most useful cyan-forming couplers are conventional phenol compounds and α-naphthol compounds. Examples of cyan couplers can be selected from those described in U.S. Pat. Nos. 2,369,929; 2,474,293; 3,591,383; 2,895,826; 3,458,315; 3,311,476; 3,419,390; 3,476,563 and 3,253,924; in British patent 1,201,110, and in Research Disclosure 308119, Section VII, 1989.

The most useful magenta-forming couplers which may be used in combination with the magenta couplers of the present invention are conventional pyrazolone type compounds, indazolone type compounds, cyanoacetyl compounds, pyrazolotriazole type compounds, etc, and particularly preferred couplers are pyrazolone type compounds. Magenta-forming couplers are described for example in U.S. Pat. Nos. 2,600,788, 2,983,608, 3,062,653, 3,127,269, 3,311,476, 3,419,391, 3,519,429, 3,558,319, 3,582,322, 3;615,506, 3,834,908 and 3,891,445,in DE patent 1,810,464, in DE patent applications 2,408,665, 2,417,945, 2,418,959 and 2,424,467; in JP patent applications 20,826/76, 58,922/77, 129,538/74, 74,027/74, 159,336/75, 42,121/77, 74,028/74, 60,233/75, 26,541/76 and 55,122/78, and in Research Disclosure 308119, Section VII, 1989.

The most useful yellow-forming couplers are conventional open-chain ketomethylene type couplers. Particular examples of such couplers are benzoylacetanilide type and pivaloyl acetanilide type compounds. Yellow-forming couplers that can be used are specifically described in U.S. Pat. Nos. 2,875,053, 3,235,924, 3,265,506, 3,278,658, 3,369,859, 3,408,194, 3,415,652 3,528,322, 3,551,151, 3,682,322, 3,725,072 and 3,891,445, in DE patents 2,219,917, 2,261,361 and 2,414,006, in GB patent 1,425,020, in JP patent 10,783/76 and in JP patent applications 26,133/72, 73,147/73, 102,636/76, 6,341/75, 123,342/75, 130,442/75, 1,827/76, 87,650/75, 82,424/77 and 115,219/77, and in Research Disclosure 308119, Section VII, 1989.

Colored couplers can be used which include those described for example in U.S. Pat. Nos. 3,476,560, 2,521,908 and 3,034,892, in JP patent publications 2,016/69, 22,335/63, 11,304,67 and 32,461/69, in JP patent applications 26,034/76 and 42,121/77 and in DE patent application 2,418,959. The light-sensitive silver halide color photographic element may contain high molecular weight color couplers as described for example in U.S. Pat. No. 4,080,211, in EP Pat. Appl. No. 27,284 and in DE Pat. Appl. Nos. 1,297,417, 2,407,569, 3,148,125, 3,217,200, 3,320,079, 3,324,932, 3,331,743, and 3,340,376, and in Research Disclosure 308119, Section VII, 1989.

Colored cyan couplers can be selected from those described in U.S. Pat. Nos. 3,934,802; 3,386,301 and 2,434,272, colored magenta couplers can be selected from the colored magenta couplers described in U.S. Pat. Nos. 2,434,272; 3,476,564 and 3,476,560 and in British patent 1,464,361. Colorless couplers can be selected from those described in British patents 861,138; 914,145 and 1,109,963 and in U.S. Pat. No. 3,580,722 and in Research Disclosure 308119, Section VII, 1989.

Also, couplers providing diffusible colored dyes can be used together with the above mentioned couplers for improving graininess and specific examples of these couplers are magenta couplers described in U.S. Pat. No. 4,366,237 and GB Pat. No. 2,125,570 and yellow, magenta and cyan couplers described in EP Pat. No. 96,873, in DE Pat. Appl. No. 3,324,533 and in Research Disclosure 308119, Section VII, 1989.

Also, among the 2-equivalent couplers are those couplers which carry in the coupling position a group which is released in the color development reaction to give a certain photographic activity, e.g., as development inhibitor or accelerator or bleaching accelerator, either directly or after removal of one or further groups from the group originally released. Examples of such 2-equivalent couplers include the known DIR couplers as well as DAR, FAR and BAR couplers. Typical examples of said couplers are described in DE Pat. Appl. Nos. 2,703,145, 2,855,697, 3,105,026, 3,319,428, 1,800,420, 2,015,867, 2,414,006, 2,842,063, 3,427,235, 3,209,110, and 1,547,640, in GB Pat. Nos. 953,454 and 1,591;641, in EP Pat. Appl. Nos. 89,843, 117,511, 118,087, 193,389, and 301,477 and in Research Disclosure 308119, Section VII, 1989.

Examples of non-color forming DIR coupling compounds which can be used in silver halide color elements include those described in U.S. Pat. Nos. 3,938,996; 3,632,345; 3,639,417; 3,297,445 and 3,928,041; in German patent applications Ser. Nos. 2,405,442; 2,523,705; 2,460,202; 2,529,350 and 2,448,063; in Japanese patent applications Ser. Nos. 143,538/75 and 147,716/75, in British patents 1,423,588 and 1,542,705 and 301,477 and in Research Disclosure 308119, Section VII, 1989.

In order to introduce the couplers into the silver halide emulsion layer, some conventional methods known to the skilled in the art can be employed. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE patents 853,512 and 869,816, in U.S. Pat. Nos. 4,214,047 and 4,199,363 and in EP patent 14,921. It consists of mixing a solution of the couplers in a water-miscible organic solvent with a polymeric latex consisting of water as a continuous phase and of polymeric particles having a mean diameter ranging from 0.02 to 0.2 micrometers as a dispersed phase.

Another: useful method is further the Fisher process. According to such a process, couplers having a water-soluble group, such as a carboxyl group, a hydroxy group, a sulfonic group or a sulfonamido group, can be added to the photographic layer for example by dissolving them in an alkaline water solution.

Useful methods of introduction of couplers into silver halide emulsions are described in Research Disclosure 308119, Section VII, 1989.

The layers of the photographic elements can be coated on a variety of supports, such as cellulose esters supports (e.g., cellulose triacetate supports), paper supports, polyesters film supports (e.g., polyethylene terephthalate film supports or polyethylene naphthalate film supports), and the like, as described in Research Disclosure 308119, Section XVII, 1989.

The photographic elements according to this invention, may be processed after exposure to form a visible image upon association of the silver halides with an alkaline aqueous medium in the presence of a developing agent contained in the medium or in the material, as known in the art. The aromatic primary amine color developing agent used in the photographic color developing composition can be any of known compounds of the class of p-phenylendiamine derivatives, widely employed in various color photographic process. Particularly useful color developing agents are the p-phenylendiamine derivatives, especially the N,N-dialkyl-p-phenylene diamine derivatives wherein the alkyl groups or the aromatic nucleus can be substituted or not substituted.

Examples of p-phenylene diamine developers include the salts of: N,N-diethyl-p-phenylendiamine, 2-amino-5-diethylamino-toluene, 4-amino-N-ethyl-N-(α-methanesulphonamidoethyl)-m-toluidine, 4-amino-3-methyl-N-ethyl-N-(α-hydroxy-ethyl)-aniline, 4-amino-3-(α-methylsulfonamidoethyl)-N,N-diethylaniline, 4-amino-N,N-diethyl-3-(N'-methyl-α-methylsulfonamido)-aniline, N-ethyl-N-methoxy-ethyl-3-methyl-p-phenylenediamine and the like, as described, for instance, in U.S. Pat. Nos. 2,552,241;2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic material), 4-amino-N-ethyl-N-(α-methanesulfonamidoethyl)-m-toluidine sesquisulfate monohydrate (generally known as CD3 and used in the developing solution for photographic papers and color reversal materials) and 4-amino-3-methyl-N-ethyl-N-(β-hydroxy, ethyl)-aniline sulfate (generally known as CD4 and used in the developing solutions for color negative photographic materials).

Said color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978, and in Research Disclosure 308119, Sections XIX and XX, 1989.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt of an alkali metal or of ammonium and of trivalent iron with an organic acid, e.g. EDTA.Fe. $NH_4$, wherein EDTA is the ethylenediaminotetracetic acid, or PDTA.Fe. $NH_4$, wherein PDTA is the propylenediaminotetracetic acid. While processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath can contain known fixing agents, such as for example ammonium or alkali metal thiosulfates. Both bleaching and fixing baths can contain other additives, e.g., polyalkyleneoxide compounds, as described for example in GB patent 933,008 in order to increase the effectiveness of the bath, or thioether compounds known as bleach accelerators.

The present invention will be illustrated with reference to the following examples, but is should be understood that these examples do not limit the present invention.

EXAMPLE 1

A mixture of 8 g of the comparison 4-equivalent magenta coupler A, 8.75 g of tricresylphosphate and 12.9 g of ethyl acetate was heated at 60° C. to prepare a solution. The resulting solution was added to 60 g of an aqueous solution containing 10% by weight of gelatin and 6 g of an aqueous solution containing 10% by weight of Hostapur SAS™ surfactant at 60° C. and the mixture was stirred using a homogenizer to prepare a coupler dispersion. The dispersion was mixed with a silver bromoiodide emulsion and coated on a cellulose triacetate film support to form a photographic light-sensitive material (Film A1). The film contained, per square meter, 2.9 g of silver and 0.6 g of coupler.

Similar dispersions were prepared except for using comparison couplers B, C and D, and couplers I-1, I-2 and I-3 of this invention. Each coupler dispersion was mixed with the same silver bromoiodide emulsion described above and coated on a cellulose triacetate film support to form Films B1 to G1, respectively, each film containing the same amount of silver of Film A1 and equimolecular amounts of coupler.

Samples of Films A1 to G1 were exposed to a light source having a color temperature of 5,500K (white light exposure). The exposed samples were then color processed using the KODAK FLEXICOLOR (C41) process as described in *British Journal of Photography Annual*, 1988, pp. 196–198, in the following sequence:

1. Color development
2. Bleach
3. Wash
4. Fix
5. Wash

For each selectively and color processed sample, values of maximum color density (Dmax) were determined. The processed film samples were stored for 50 hours under exposure to a day-light Xenon lamp of about 180,000 luxes and the density reduction (%Dmax Loss) of the magenta dye image from the initial density was measured. The results obtained are reported in Table 1.

TABLE 1

| Film | Coupler | Dmax | % Dmax Loss |
|---|---|---|---|
| A1 (comp.) | A | 1.94 | 88 |
| B1 (comp.) | B | 3.26 | 67 |
| C1 (comp.) | C | 3.12 | 74 |
| D1 (comp.) | D | 3.12 | 88 |
| E1 (inv.) | I-1 | 3.44 | 57 |
| F1 (inv.) | I-2 | 2.35 | 66 |
| G1 (inv.) | I-3 | 2.51 | 66 |

It is apparent from these results that magenta dye images obtained using the 2-equivalent couplers of the invention are more stable to light than comparison couplers.

Formulas of comparison couplers used in this example will be presented below.

Comparison coupler A:

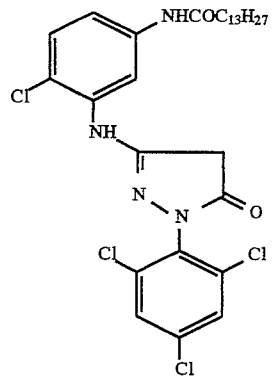

Comparison coupler B:

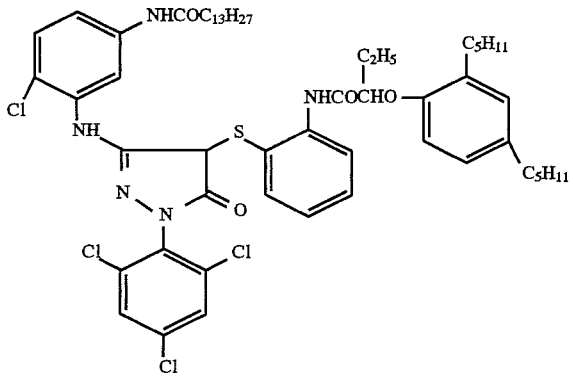

Comparison coupler C:

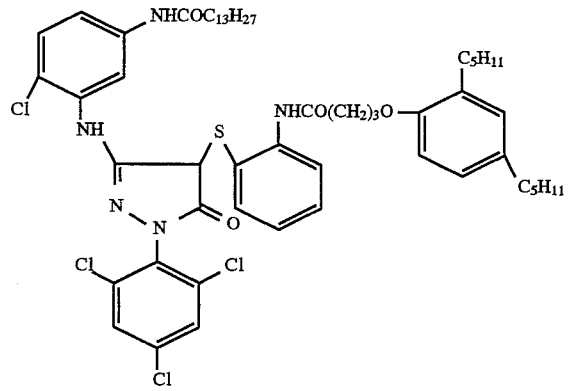

Comparison coupler D:

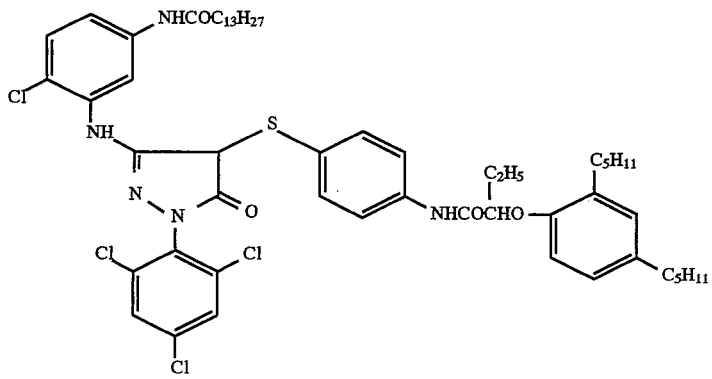

EXAMPLE 2

A multilayer silver halide color photographic film A2 was prepared by coating a cellulose triacetate support base, subbed with gelatin, with the following layers in the following order:

(1) a layer of black colloidal silver dispersed in gelatin having a silver coverage of 0.26 g/m$^2$ and a gelatin coverage of 1.33 g/m$^2$;

(2) a layer of low sensitivity red-sensitive silver halide emulsion comprising a sulfur and gold sensitized low-sensitivity silver bromoiodide emulsion (having 2.5% silver iodide moles and a mean grain size of 0.18 μm), optimally spectrally sensitized with sensitizing dyes S-1, S-2 and S-3, at a total silver coverage of 0.72 g/m$^2$ and a gelatin coverage of 0.97 g/m$^2$, containing the cyan dye-forming coupler C-1 at a coverage of 0.357 g/m$^2$, the cyan dye-forming DIR coupler C-2 at a coverage of 0.024 g/m$^2$ and the magenta colored cyan-dye forming masking coupler C3 at a coverage of 0.052 g/m$^2$, dispersed in a mixture of tricresylphosphate and butylacetanilide;

(3) a layer of medium-sensitivity red-sensitive silver halide emulsion comprising a sulfur and gold sensitized silver chloro-bromo-iodide emulsion (having 7% silver iodide moles and 5% silver chloride moles and a mean grain size of 0.45 μm), optimally spectrally sensitized with sensitizing dyes S-1, S-2 and S-3, at a silver coverage of 0.84 g/m$^2$ and a gelatin coverage of 0.81 g/m$^2$, containing the cyan dye-forming coupler C-1 at a coverage of 0.324 g/m$^2$, the cyan dye-forming DIR coupler C-2 at a coverage of 0.024 g/m$^2$, and the magenta colored cyan dye-forming masking coupler C-3 at a coverage of 0.052 g/m$^2$, dispersed in a mixture of tricresylphosphate and butylacetanilide;

(4) a layer of high-sensitivity red-sensitive silver halide emulsion comprising a sulfur and gold sensitized silver bromo-iodide emulsion (having 12% silver iodide moles and a mean grain-size of 1.1 μm), optimally spectrally sensitized with sensitizing dyes S-1, S-2 and S-3, at a silver coverage of 1.53 g/m$^2$, and a gelatin coverage of 1.08 g/m$^2$, containing the cyan dye-forming coupler C-1 at a coverage of 0.223 g/m$^2$, and the cyan dye-forming DIR coupler C-2 at a coverage of 0.018 g/m$^2$, and the cyan dye-forming coupler C-4 at a coverage of 0.032 g/m$^2$, dispersed in a mixture of tricresylphosphate and butylacetanilide;

(5) an intermediate layer containing 0.10 g/m$^2$ of a fine gain silver bromide emulsion, 1.13 g/m$^2$ of gelatin, 0.025 g/m$^2$ of UV absorber UV-1 and 0.025 g/m$^2$ of UV absorber UV-2;

(6) a layer of low sensitivity green sensitive silver halide emulsion comprising a blend of 63% by weight of the low-sensitivity emulsion of layer (2) and of 37% by weight of the medium-sensitivity emulsion of layer (3) at a silver coverage of 1.44 g/m$^2$, optimally spectrally sensitized with sensitizing dyes S-4 and S-5, at a gelatin coverage of 1.54 g/m$^2$, containing the magenta dye-forming coupler M-1 at a coverage of 0.479 g/m$^2$, the magenta dye-forming DIR coupler M-2 at a coverage of 0.025 g/m$^2$, and the yellow colored magenta dye-forming couplers M-3 and M-4 at a coverage of 0.205 g/m$^2$, dispersed in tricresylphosphate;

(7) a layer of high-sensitivity green sensitive silver halide emulsion comprising a sulfur and gold sensitized silver bromo-iodide emulsion (having 12% silver iodide moles and a mean grain size of 1.1 μm), optimally spectrally sensitized with sensitizing dyes with sensitizing dyes S-4 and S-5, at a silver coverage of 1.60 g/m$^2$ and a gelatin coverage of 1.03 g/m$^2$, containing the magenta dye-forming coupler M-1 at a coverage of 0.121 g/m$^2$, the magenta dye-forming DIR coupler M-2 at a coverage of 0.03 g/m$^2$, and the yellow colored magenta dye forming couplers M-3 and M-4 at a coverage of 0.059 g/m$^2$, dispersed in tricresylphosphate;

(8) an intermediate layer containing 1.06 g/m$^2$ of gelatin;

(9) a yellow filter layer containing 1.14 g/m$^2$ of gelatin and 0.045 g/m$^2$ of silver;

(10) a layer of low-sensitivity blue-sensitive silver halide emulsion comprising a blend of 63% by weight of the low-sensitivity emulsion of layer (2) and of 37% by weight of the medium-sensitivity emulsion of layer (3) at a silver coverage of 0.53 g/m$^2$, optimally spectrally sensitized with sensitizing dye S-6, at a gelatin coverage of 1.65 g/m$^2$, containing the yellow dye forming coupler Y-1 at a coverage of 1.42 g/m$^2$ and the yellow dye forming DIR coupler Y-2 at a coverage of 0.027 g/m$^2$, dispersed in a mixture of diethyllauramide and dibutylphthalate;

(11) a layer of high-sensitivity blue sensitive silver halide emulsion comprising a sulfur and gold sensitized silver bromo-iodide emulsion (having 12% silver iodide moles and a mean gain size of 1.1 μm), optimally spectrally sensitized with sensitizing dye S-6, at a silver coverage of 0.92 g/m$^2$ and a gelatin coverage of 1.25 g/m$^2$, containing the yellow dye-forming coupler Y-1 at a coverage of 0.765 g/m$^2$ and the yellow dye forming DIR coupler Y-2 at a coverage of 0.02 g/m$^2$, dispersed in a mixture of diethyllauramide and dibutylphthalate;

(12) a protective layer of 1.29 g/m$^2$ of gelatin, comprising the UV absorber UV-1 at a coverage of 0.12 g/m$^2$, the UV absorber UV-2 at a coverage of 0.12 g/m$^2$, a fine grain silver bromide emulsion at a silver coverage of 0.15 g/m$^2$; and

(13) a top coat layer of 0.75 g/m$^2$ of gelatin containing 0.273 g/m$^2$ of polymethylmethacrylate matting agent MA-1 in form of beads having an average diameter of 2.5 micrometers, and the 2,4-dichloro-6-hydroxy-1,3,5-triazine hardener H-1 at a coverage of 0.468 g/m$^2$.

Film B2 was prepared in a similar manner, but employing, instead of the 4-equivalent magenta dye-forming coupler M-1, 0.424 g/m$^2$ in layer 6 and 0.105 g/m$^2$ in layer 7 of the comparative 2-equivalent magenta dye-forming coupler E.

Film C2 was prepared in a similar manner, but employing, instead of the 4-equivalent magenta dye-forming coupler M-1, 0.479 g/m$^2$ in layer 6 and 0.121 g/m$^2$ in layer 7 of the comparative 2-equivalent magenta dye-forming coupler B of Example 1.

Film D2 was prepared in a similar manner, but employing, instead of the 4-equivalent magenta dye-forming coupler M-1, 0.479 g/m$^2$ in layer 6 and 0.121 g/m$^2$ in layer 7 of the 2-equivalent magenta dye-forming coupler I-1 of the present invention.

Samples of Films A2, B2, C2 and D2 were exposed to a light source having a color temperature of 5,500K (white light exposure). The exposed samples were then color processed as described in Example 1. For each exposed and color processed sample, the characteristic curves for the red, green and blue light absorptions were obtained conventionally. Values of sensitivity in Log E at density of 0.2 above Dmin (Speed1), toe contrast (Gamma), and granularity (RMS) for magenta layer of each Film are reported in Table 2. The measure of RMS granularity was made at density 1.0 above Dmin, using the ISO Standard 10505 (IOW 161): the lower the number, the lower the granularity of the image.

TABLE 2

| Film | Speed1 | Gamma | RMS |
|---|---|---|---|
| A2 (comp.) | 2.37 | 0.52 | 10.2 |
| B2 (comp.) | 2.43 | 0.65 | 13.7 |
| C2 (comp.) | 2.40 | 0.61 | 13.2 |
| D2 (inv.) | 2.38 | 0.71 | 10.9 |

Formulas of compounds used in this example will be presented below.

Cyan dye forming coupler C-1:

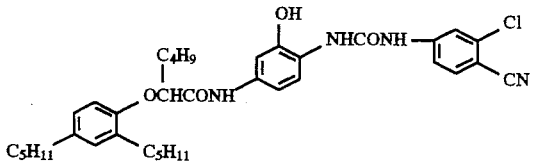

Cyan dye forming DIR coupler C-2:

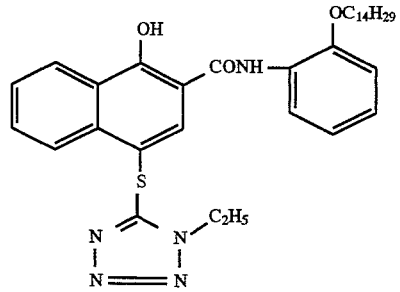

Magenta colored cyan dye forming Coupler C-3:

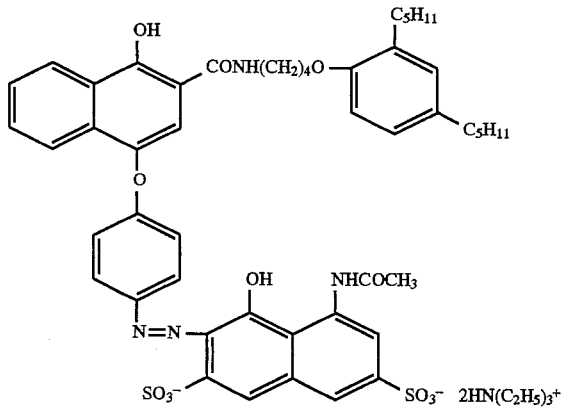

Cyan dye forming coupler C-4:

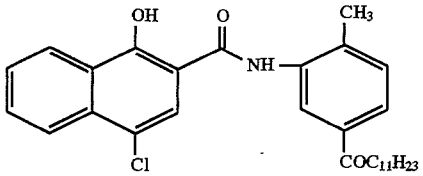

Magenta dye forming coupler M-1:

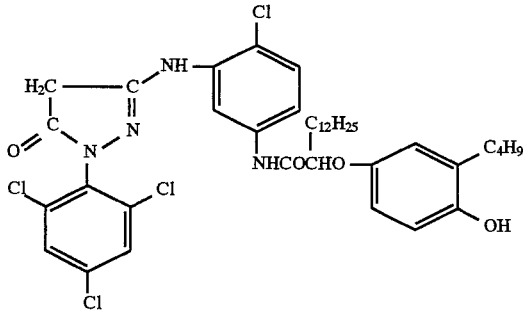

Magenta dye forming DIR coupler M-2:
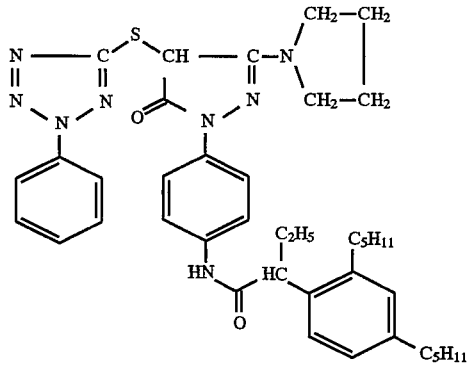
Magenta dye forming coupler E:
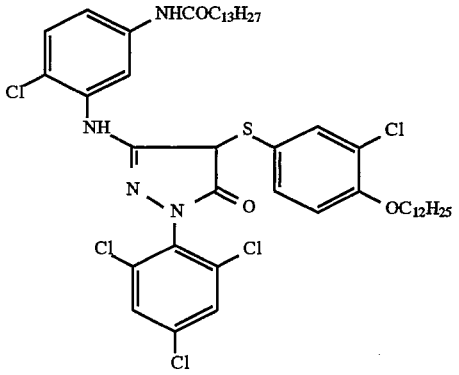
Yellow colored magenta dye forming coupler M-3:
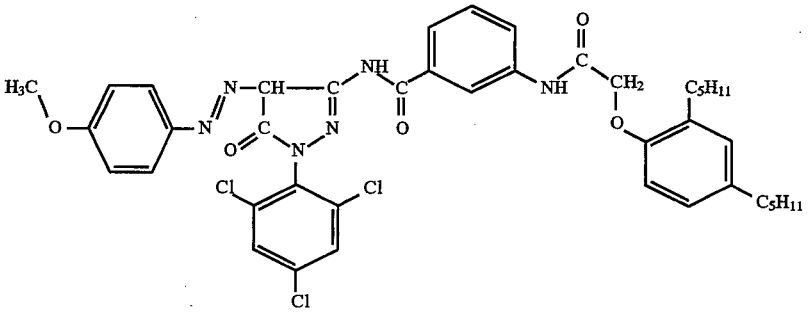
Yellow colored magenta dye forming coupler M-4:
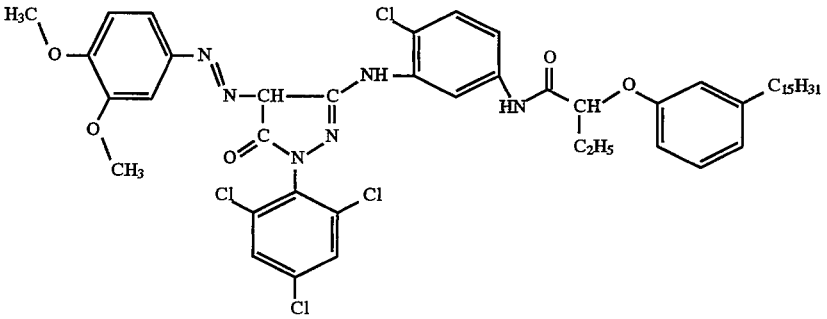

Magenta dye forming coupler B:
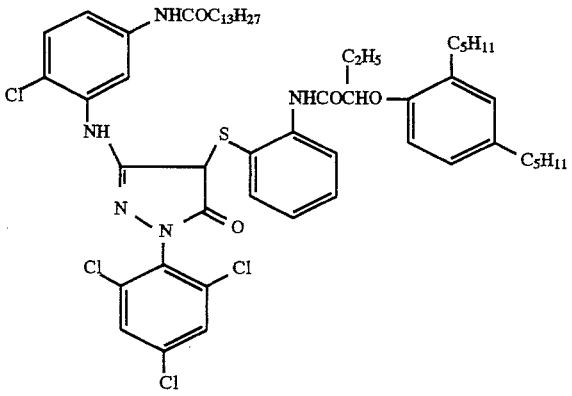
Yellow dye forming coupler Y-1:
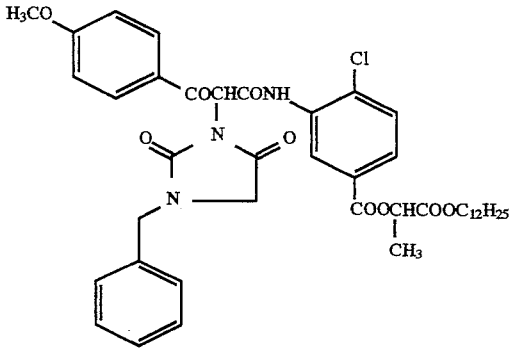
Yellow dye forming DIR coupler Y-2:
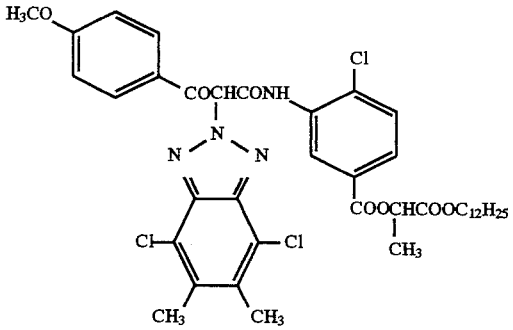
Red Sensitizer S-1
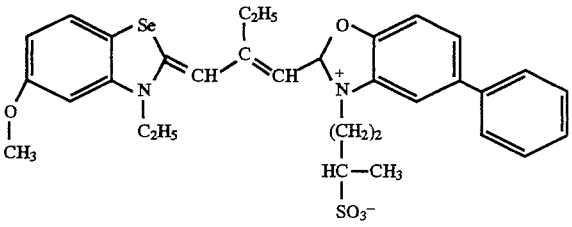
Red Sensitizer S-2
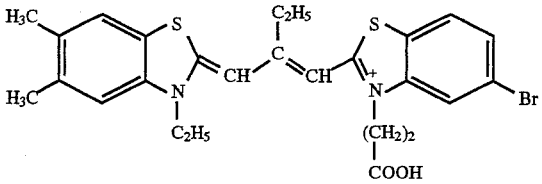
Red Sensitizer S-3
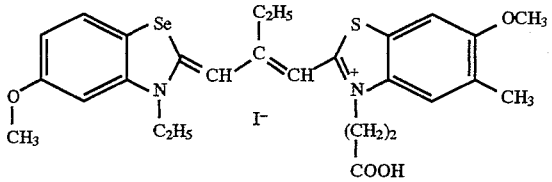
Green Sensitizer S-4
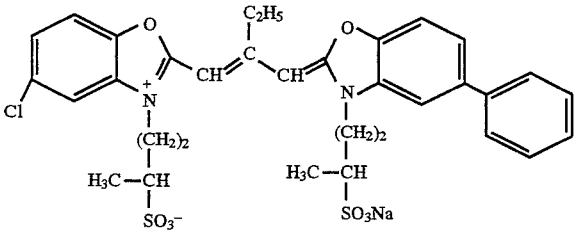
Green Sensitizer S-5
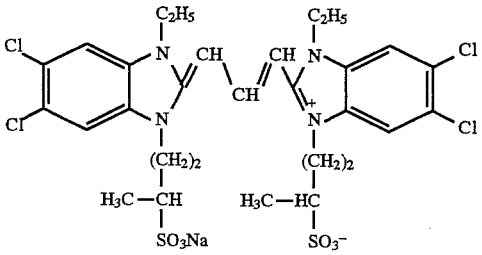
Blue Sensitizer S-6
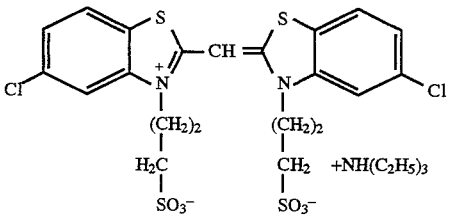

UV absorber UV-1:

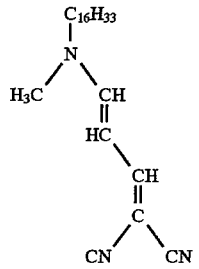

UV absorber UV-2:

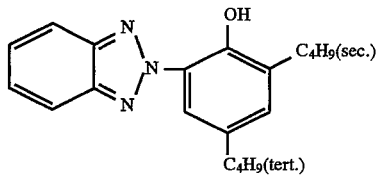

Matting agent MA-1:

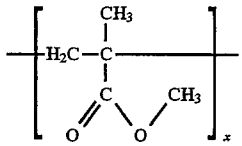

Hardener H-1:

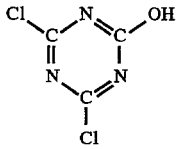

EXAMPLE 3

Film A3 was prepared similar to film A2 of Example 2, but employing, instead of the green sensitive silver halide emulsion layers 6 and 7, the following layers in sequence:

(a) a layer of low sensitivity green sensitive emulsion comprising a sulfur and gold sensitized low-sensitivity silver bromoiodide emulsion (having 2.5% silver iodide moles and a mean grain size of 0.18 μm), optimally spectrally sensitized with sensitizing dyes S-4 and S-5, at a total silver coverage of 0.65 g/m$^2$ and a gelatin coverage of 1.2 g/m$^2$, containing the magenta dye-forming coupler B at a coverage of 0.285 g/m$^2$, the magenta dye-forming DIR coupler M-2 at a coverage of 0.015 g/m$^2$, and the yellow colored magenta dye-forming couplers M-3 and M-4 at a coverage of 0.103 g/m$^2$, dispersed in tricresylphosphate;

(b) a layer of medium sensitivity green sensitive emulsion comprising a sulfur and gold sensitized silver chlorobromo-iodide emulsion (having 7% silver iodide moles and 5% silver chloride moles and a mean grain size of 0.45 μm), optimally spectrally sensitized with sensitizing dyes S-4 and S-5, at a total silver coverage of 0.74 g/m$^2$ and a gelatin coverage of 0.9 g/m$^2$, containing the magenta dye-forming coupler B at a coverage of 0.150 g/m$^2$, the magenta dye-forming DIR coupler M-2 at a coverage of 0.005 g/m$^2$, and the yellow colored magenta dye-forming couplers M-3 and M-4 at a coverage of 0.110 g/m$^2$, dispersed in tricresylphosphate;

(c) a layer of high sensitivity green sensitive emulsion comprising a sulfur and gold sensitized silver bromoiodide emulsion (having 12% silver iodide moles and a mean grain size of 1.1 μm), optimally spectrally sensitized with sensitizing dyes S-4 and S-5, at a total silver coverage of 1.5 g/m$^2$ and a gelatin coverage of 1.2 g/m$^2$, containing the magenta dye-forming coupler B at a coverage of 0.1 g/m$^2$, the magenta dye-forming DIR coupler M-2 at a coverage of 0.003 g/m$^2$, and the yellow colored magenta dye-forming couplers M-3 and M-4 at a coverage of 0.04 g/m$^2$, dispersed in tricresylphosphate.

Film B3 was prepared in a similar manner, but employing, instead of the 2-equivalent magenta dye-forming coupler B, the 2-equivalent magenta dye-forming coupler I-1 of the present invention.

Samples of films A3 and B3 were exposed and processed as described in Example 2. For each exposed and color processed sample, the characteristic curves for the red, green and blue light absorptions were obtained conventionally. Values of sensitivity in Log E at density of 0.2 above Dmin (Speed1), contrast (Gamma) and granularity (RMS) for magenta layer of each film are reported in Table 3.

TABLE 3

| Film | Speed1 | Gamma | RMS |
|---|---|---|---|
| A3 (comp.) | 2.26 | 0.59 | 11.63 |
| B3 (inv.) | 2.27 | 0.53 | 10.84 |

EXAMPLE 4

Potentiometric titrations were used to measure the pKa of the 2-equivalent magenta couplers of the invention in comparison with conventional 4-equivalent and 2-equivalent magenta couplers. The couplers were dissolved in Dimethylformamide and water, and the solution was titred with aqueous NaOH. The term pKa denotes the aqueous buffer pH at which half of the coupler is ion paired. Table 4 lists pKa values measured with 0.1N sodium counter ion.

TABLE 4

| Coupler | pKa |
|---|---|
| A (comp.) | 9.44 |
| M-1 (comp.) | 9.80 |
| B (comp.) | 5.47 |
| I-1 (inv.) | 6.47 |
| I-2 (inv.) | 6.47 |
| I-4 (inv.) | 6.70 |

The pKa values of the 2-equivalent magenta couplers of the invention result higher than the pKa of the comparison 2-equivalent magenta coupler B.

EXAMPLE 5

8 g of the 4-equivalent magenta coupler A were dissolved in 8.75 of a coupler solvent and 12.9 g of ethyl acetate as an auxiliary solvent. The mixture was added to 60 g of an aqueous 10% by weight gelatin solution and 6 g of an aqueous 10% by weight HOSTAPUR SAS solution as a surfactant. The two-phase mixture was then passed through a colloid mill to disperse the coupler-containing oil phase in the aqueous phase in the form of small particles. The resulting dispersion was coated on the cellulose triacetate support at a coupler coverage of 38 mmole/mole Ag with a silver bromoiodide emulsion at a silver coverage of 2.9 $g/m^2$. A top coat containing 1.0 $g/m^2$ of gelatin and the gelatin hardener H-1 was coated over the emulsion layer (Film A5).

Other films were obtained similar to film A5, but using the couplers listed in the following Table 5.

Samples of the films were exposed and subjected to variants of the KODAK FLEXICOLOR (C41) process described in Example 1. A first set of samples was subjected to the standard C-41 process described above with no stop bath between the development and the bleach steps (process A). A second set of samples was processed without a stop bath but with the bleach pH adjusted to 6.0 instead of the normal 5.25 (process B), to simulate behavior in a "seasoned" bleach with increased pH due to carry-over of alkali from the developer solution. A third set of samples was processed with an acetic acid stop bath between the development and bleach steps (process C), to eliminate any continued coupling. Process conditions were those reported in Example 2 of EP 529,727. The differences in Dmin values resulting from process A and process C or process B and process C are measures of the continued coupling at bleach pH values of 5.25 and 6.0, respectively. These differences are reported in Table 5.

TABLE 5

| Film | Coupler | Delta Dmin Process A–C | Delta Dmin Process B–C |
|---|---|---|---|
| A5 | A (comp.) | 0.00 | 0.00 |
| B5 | B (comp.) | 0.00 | 0.15 |
| C5 | I-1 (inv.) | 0.00 | 0.10 |
| D5 | I-4 (inv.) | 0.00 | 0.06 |

As shown by the delta Dmin values in Table 5, the 2-equivalent magenta couplers of the invention are more effective than the comparison 2-equivalent magenta coupler B in reducing continued coupling in the absence of a stop bath in the simulated seasoned (pH 6.0) bleach.

EXAMPLE 6

A first set of samples of films A2, C2 and D2 of Example 2 was subjected to the standard C-41 process with no stop bath between the development and bleach steps (process A). A second set of samples of films was processed with a Rapid Access bleach bath containing 30% by volume of developer solution (process D), having a pH increased from 4.6 to 5.1, for a bleaching time of 3'15". The differences in Dmin values resulting from process D and process A are measures of the effectiveness of the 2-equivalent coupler of the invention in reducing Dmin increase in the simulated seasoned (contaminated with developer) bleach. These differences are reported in Table 6.

TABLE 6

| Film | Coupler | Delta Dmin Process D–A |
|---|---|---|
| A2 | M-1 (comp.) | 0.11 |
| C2 | B (comp.) | 0.14 |
| D2 | I-1 (inv.) | 0.11 |

We claim:

1. A silver halide photographic element comprising a support and at least one silver halide emulsion layer having therein a 2-equivalent 1-phenyl-3-anilino-4-phenylthio-5-pyrazolone magenta coupler, wherein both the 3-anilino and 4-phenylthio groups comprise a ballasting group, and the 4-phenylthio group comprise an alkylaryloxyalkylenecarbamoyl group being in 2-position with respect to the carbon atom attached to the sulfur atom and bearing said ballasting group, and the sum of sigma values of substituents on the 1-phenyl and the 3-anilino groups is less than 1.3.

2. A photographic element as claimed in claim 1, wherein the 2-equivalent 1-phenyl-3-anilino-4-phenylthio-5-pyrazolone magenta coupler is represented by the formula:

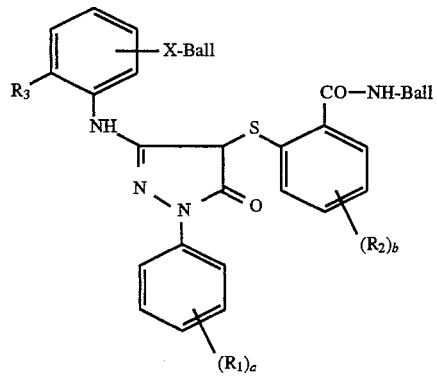

wherein a represents an integer from 0 to 3, b represents an integer from 0 to 2, $R_1$ and $R_2$ are each individually hydrogen, alkyl, alkoxy, halogen, aryl, aryloxy, acylamino, sulfonamido, sulfamoyl, carbamoyl, arylsulfonyl, aryloxycarboyl, alkoxycarbonyl, alkoxysulfonyl, aryloxysulfonyl, alkylureido, arylureido, nitro, cyano, hydroxyl or carboxy group, $R_3$ is halogen atom, alkyl group or aryl group, X is a direct link or a linking group, Ball is alkylaryloxyalkylene ballasting group which renders a group to which is attached non-diffusible in photographic coatings, and the sum of the sigma values of $R_1$, $R_3$ and X-Ball is less than 1.3.

3. A photographic element as claimed in claim 2, wherein Ball comprises a hydrophobic group of at least 8 carbon atoms.

4. A photographic element as claimed in claim 2, wherein X is an imino, ether, carbonamido, sulfonamido, ureido, imido, carbamoyl or sulfamoyl group.

5. A photographic element as claimed in claim 2, wherein R3 is chlorine.

6. A photographic element as claimed in claim 2, wherein R1 is chlorine, a represents 3 and chlorine atoms are in the positions 2, 4 and 6 to the carbon atom attached to the nitrogen atom.

7. A photographic element as claimed in claim 2, wherein X is a carbonamido group.

8. A photographic element as claimed in claim 1, wherein the silver halide emulsion is spectrally sensitized to green light.

9. A silver halide color photographic element comprising at least one blue light sensitive silver halide emulsion layer which comprises a yellow dye forming coupler, at least one green light sensitive silver halide emulsion layer which comprises a magenta dye forming coupler, and at least one red light sensitive silver halide emulsion layer which comprises a cyan dye forming coupler, wherein said magenta dye forming coupler is represented by the formula:

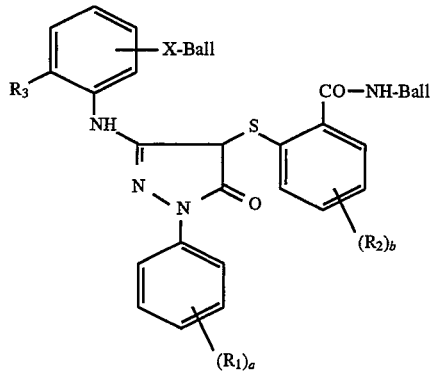

wherein a represents an integer from 0 to 3, b represents an integer from 0 to 2, $R_1$ and $R_2$ are each individually hydrogen, alkyl, alkoxy, halogen, aryl, aryloxy, acylamino, sulfonamido, sulfamoyl, carbamoyl, arylsulfonyl, aryloxycarbonyl, alkoxycarbonyl, alkoxysulfonyl, aryloxysulfonyl, alkylureido, arylureido, nitro, cyano, hydroxyl or carboxy group, $R_3$ is halogen atom, alkyl or aryl group, X is a direct link or a linking group, Ball is an alkylaryloxyalkylene ballasting group which renders a group to which is attached non-diffusible in photographic coatings, and the sum of the sigma values of $R_1$, $R_3$ and X-Ball is less than 1,3.

10. A silver halide color photographic element comprising at least one blue light sensitive silver halide emulsion layer which comprises a yellow dye forming coupler, at least one green light sensitive silver halide emulsion layer which comprises a magenta dye forming coupler, and at least one red light sensitive silver halide emulsion layer which comprises a cyan dye forming coupler, wherein said magenta dye forming coupler is represented by the formula:

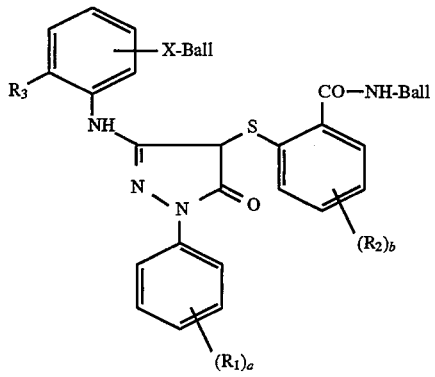

wherein a represents an integer from 0 to 3, b represents an integer from 0 to 2, $R_1$ and $R_2$ are each individually hydrogen, alkyl, alkoxy, halogen, aryl, aryloxy, acylamino, sulfonamido, sulfamoyl, carbamoyl, arylsulfonyl, aryloxycarbonyl, alkoxycarbonyl, alkoxysulfonyl, aryloxysulfonyl, alkylureido, arylureido, nitro, cyano, hydroxyl or carboxy moiety, $R_3$ is halogen atom, alkyl or pheny moiety, X is a direct link or a linking group, Ball is an alkylaryloxyalkylene ballasting group which renders a group to which is attached non-diffusible in photographic coatings, and the sum of the sigma values of $R_1$, $R_3$ and X-Ball is less than 1.3.

* * * * *